US005823647A

United States Patent [19]

Miyoshi

[11] Patent Number: 5,823,647

[45] Date of Patent: Oct. 20, 1998

[54] PAPER HOLDER MOUNTING MECHANISM

[75] Inventor: Yoshitake Miyoshi, Osaka, Japan

[73] Assignee: Mita Industrial Co., Ltd., Osaka-fu, Japan

[21] Appl. No.: 814,962

[22] Filed: Mar. 10, 1997

[30] Foreign Application Priority Data

Mar. 12, 1996 [JP] Japan ..... 8-054784

[51] Int. Cl.[6] ..... A47B 88/00

[52] U.S. Cl. ..... 312/333; 312/334.4; 312/334.22; 252/146; 271/162

[58] Field of Search ..... 312/330.1, 333, 312/334.4, 334.6, 334.7, 334.11, 334.8, 334.14, 334.15, 334.17, 334.22, 334.44; 292/146, 300, DIG. 4; 384/18, 21; 271/162, 164

[56] References Cited

U.S. PATENT DOCUMENTS

| | | | |
|---|---|---|---|
| 1,816,213 | 7/1931 | Duke | 312/334.21 X |
| 3,658,394 | 4/1972 | Gutner | 384/21 |
| 4,159,153 | 6/1979 | Yoshikawa | 312/333 |
| 4,983,000 | 1/1991 | Rock | 312/334.4 X |
| 5,065,920 | 11/1991 | Amner | 312/334.7 X |
| 5,209,572 | 5/1993 | Jordan | 384/18 |
| 5,487,609 | 1/1996 | Asada | 384/18 |
| 5,586,817 | 12/1996 | Hubbard et al. | 312/330.1 X |

*Primary Examiner*—Jose V. Chen
*Assistant Examiner*—Janet M. Wilkens
*Attorney, Agent, or Firm*—Jordan and Hamburg

[57] ABSTRACT

A paper holder mounting mechanism for mounting a paper holder in an apparatus, the paper holder mounting mechanism includes a vertically-acting paper holder locking mechanism that is put to an interlocked state when the paper holder is inserted into the apparatus; a sliding guide device; and two joints disposed along the inserting direction of the paper holder for connecting the sliding guide device to one of side walls of the paper holder. The joints are set such that a rear portion of the paper holder is swingable up and down about the joint at the front to effect an interlocking action of the paper holder locking mechanism.

16 Claims, 7 Drawing Sheets

FIG. 5A
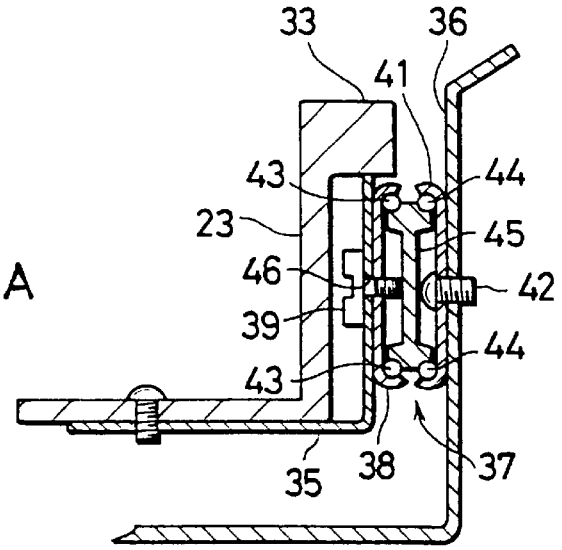
FIG. 5B
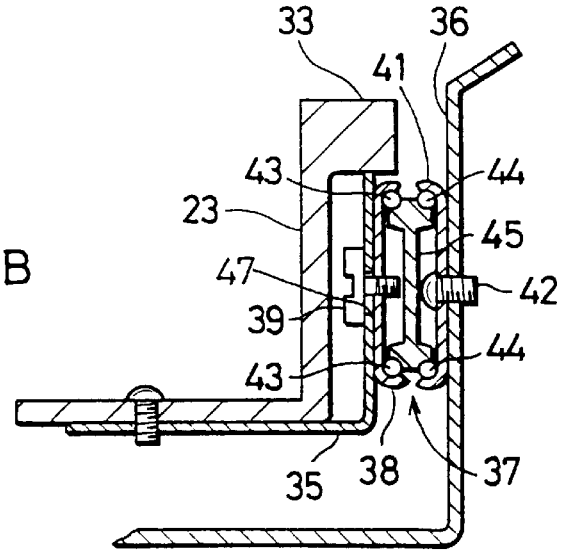
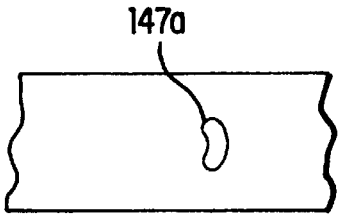
FIG. 5C
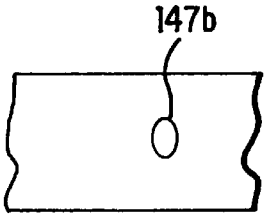
FIG. 5D

PAPER HOLDER MOUNTING MECHANISM

BACKGROUND OF THE INVENTION AND RELATED ART STATEMENT

The present invention relates to a mechanism for mounting a paper holder used in an image forming apparatus, such as a copying machine, a facsimile machine or a printer, that is provided with a paper cassette for holding a stack of paper or a double sided printing (or copying) paper holding unit which receives and temporarily holds each sheet of paper carrying an image already formed on one side thereof and then feeds it to allow another image to be formed on the other side.

In a conventional image forming apparatus like a copying machine or a facsimile machine, for instance, a paper cassette is accommodated in a lower portion of the apparatus in such a way that the paper cassette can be pulled out and reinstalled by an operator, and there is provided a cassette locking mechanism to prevent the paper cassette from coming off accidentally.

FIG. 9 is a cross-sectional side view showing the construction of a conventional cassette mounting mechanism, and FIG. 10 is a front view showing the construction of the cassette mounting mechanism of FIG. 9.

As shown in FIGS. 9 and 10, a paper cassette 1 for holding a stack of paper has projecting flanges 2 formed along upper portions of left and right side walls of the paper cassette 1. These flanges 2 run in a direction in which the paper cassette 1 is inserted, and drawn out, and their rear ends extend farther beyond the rear end of a hollow box-shaped structure of the paper cassette 1. Each flange 2 is obliquely cut from its rear edge toward its bottom edge, and this oblique portion, or a slope 3, connects to a short horizontal portion and then to a generally inverted U-shaped cutout 4 formed in the bottom edge.

In a rear section of an apparatus in which the paper cassette 1 is installed, a pair of retaining members 6 are mounted on a base plate 7 of the apparatus. Each of these retaining members 6 has at its top a protruding part 5 which fits into the inverted U-shaped cutout 4 in each flange 2 when the paper cassette 1 is inserted into the apparatus. In the example of FIGS. 9 and 10, the left and right cutouts 4 and protruding parts 5 constitute a cassette locking mechanism. Inside the apparatus, there are provided a pair of guide rails 9 having a shallow U-shaped cross section that fit over the flanges 2 formed along the left and right side walls of the paper cassette 1. The paper cassette 1 loaded with paper can be inserted into and drawn out of the apparatus as it is guided by the flanges 2 and the U-shaped guide rails 9 which form together left and right linear guides. As can be seen from FIG. 10, the inner vertical dimension of each U-shaped guide rail 9 is made a little larger than the vertical dimension of each flange 2. This allows slight vertical movements of the paper cassette 1 when the cutouts 4 in the flanges 2 fit over the respective protruding parts 5.

Provided at the front of the paper cassette 1 is a handle 10 of which front surface becomes flush with a front surface of the apparatus when the paper cassette 1 is inserted all the way into the apparatus. A horizontally elongate finger slot 11 of a specific width is formed in the handle 10. This allows an operator to grip the front of the handle 10 with fingers inserted into the finger slot 11 so that he, or she, can easily pull out the paper cassette 1 and push it back into the apparatus.

When the paper cassette 1 loaded with a stack of paper is properly inserted into the apparatus, a pair of paper feed rollers 12, each having a generally semilunar shape in front view, are located above the stack of paper with their side surfaces aligned parallel to a lateral direction of the paper cassette 1. These two paper feed rollers 12 are mounted at front and rear positions of a rotating shaft 13 which extends in the cassette inserting direction, or at right angles to the lateral direction of the paper cassette 1, with both ends of the rotating shaft 13 rotatably supported by front and rear fixing plates 14.

When loading the paper cassette 1 with a new stack of paper or changing the paper size, the operator draws out the paper cassette 1 together with remaining paper, if any, from the apparatus by pulling the handle 10 of the paper cassette 1. As the operator pulls the paper cassette 1, the cutouts 4 in the left and right flanges 2 shift obliquely forward along rear sloping surfaces of the respective protruding parts 5 and are released from the protruding parts 5. Then, the paper cassette 1 slides horizontally forward as it is further pulled, guided by the linear guides which are formed by the flanges 2 and the U-shaped guide rails 9.

After removing the paper cassette 1, the operator refills it with a new stack of paper or replaces it with another paper cassette 1 holding a stack of paper of a desired size, and then reinstalls the paper cassette 1 back to the apparatus by holding and pushing the handle 10 of the paper cassette 1. As the operator inserts the paper cassette 1 into the apparatus, it is guided again by the linear guides composed of the flanges 2 and the U-shaped guide rails 9. The slopes 3 at the rear ends of the left and right flanges 2 slide over the respective protruding parts 5, and the cutouts 4 and the protruding parts 5 lock together from top and bottom directions. This vertically-acting cassette locking mechanism prevents the paper cassette 1 from coming off loose from the apparatus.

The two paper feed rollers 12 rotate together with their rotating shaft 13 when feeding each sheet of paper during a copying operation, for example. More particularly, as the paper feed rollers 12 having a generally semilunar cross section rotate, their concave and convex outer surfaces come in contact with the upper surface of a topmost sheet of paper and a resulting frictional force causes the topmost sheet of paper to be pushed in a paper feeding direction. Individual sheets of paper successively peeled off from the underlying sheets by a separation pawl are fed into a paper path in this manner. The topmost sheet of paper fed from the paper cassette 1 is transported up to an image forming section of the apparatus and an image is transferred on that sheet of paper.

The conventional cassette mounting mechanism described above is provided with the cassette locking mechanism, and the flanges 2 on the left and right of the paper cassette 1 slide along grooves formed in the U-shaped guide rails 9 which are provided inside the apparatus to allow the paper cassette 1 loaded with a stack of paper to be inserted and drawn out. In this conventional construction, however, the paper cassette 1 can not be inserted and drawn out quite so smoothly due to the aforementioned sliding operation. In addition, there are gaps between the flanges 2 and the grooves in the U-shaped guide rails 9 to allow a vertical interlocking action of the cassette locking mechanism and, therefore, the paper cassette 1 slides more or less loosely along the U-shaped guide rails 9 so that it can swing up and down, and from side to side, producing irregular shaky movements.

One approach to achieving smooth insertion and removal of the paper cassette 1 is to use a conventional sliding guide device incorporating freely revolving balls or rollers. In this approach, however, the paper cassette 1 is tightly held in the vertical direction and it becomes impossible to use the vertically-acting cassette locking mechanism. It would be possible to use magnets or mechanical catchers to configure an alternative cassette locking mechanism. This requires additional elements including the magnets or catchers, and the vertically-acting cassette locking mechanism, which provides sure interlocking, can not be used.

SUMMARY OF THE INVENTION

It is an object of the invention to overcome the aforementioned problems of prior art technology. It is another object of the invention to provide a paper holder mounting mechanism; the paper holder mounting mechanism comprises a vertically-acting paper holder locking mechanism which enables smooth insertion and removal of a paper holder without producing irregular shaky movements, and thereby ensures easy and comfortable handling of the paper holder.

A paper holder mounting mechanism according to this invention comprises:

a vertically-acting paper holder locking mechanism that is put to an interlocked state when the paper holder is inserted into the apparatus;

a sliding guide device;

two joints disposed along the inserting direction of the paper holder for connecting the sliding guide device to a side wall of the paper holder; and the joints are set such that a rear portion of the paper holder is swingable up and down about the joint at the front to effect an interlocking action of the paper holder locking mechanism.

According to the invention, the paper holder mounting mechanism may have one or two sliding guide devices connected to the left or right side wall portion of the paper holder, or connected to both the left and right side wall portions of the paper holder. In either case, each sliding guide device is connected to the paper holder by at least two joints disposed along the paper holder inserting direction.

The sliding guide device may include a first and a second sliding plates opposingly arranged to each other; an intermediate member placed between the first and second sliding plates; a first group of upper and lower rolling members rotatably retained between the intermediate member and the first sliding plate which is adapted to be fixed to a side wall portion of the apparatus; and a second group of upper and lower rolling members rotatably retained between the intermediate member and the second sliding plate which is attached to the side wall portion of the paper holder; whereby the first and second sliding plates slidable relative to each other.

When the above construction of the invention is applied to a paper holder such as a paper cassette of an image forming apparatus, for instance, a rear portion of the paper holder of which side wall portion is connected to a sliding guide device by at least two joints can swing up and down about the joint at the front. The sliding guide device ensures smooth forward and rearward movements of the paper holder and enables a paper holder locking mechanism to be easily interlocked when the paper holder is fully inserted as a result of its up and down swinging motions. This vertically-acting, sure paper holder locking mechanism is realized with the aforementioned simple construction for enabling up and down swinging motions of the paper holder, without requiring any additional components other than the sliding guide device. The sliding guide device allows for smooth insertion and removal of the paper holder without causing its irregular shaky movements to realize easy and comfortable handling of the paper holder.

These and other objects, features and advantages of the invention will become more apparent upon reading the following detailed description in conjunction with the accompanying drawings.

BRIEF DESCRIPTION OF THE DRAWINGS

FIGS. 5A and 5B show the detailed construction of part D shown in FIG. 2, where FIG. 5A is a cross section taken along line VA—VA of FIG. 1, and FIG. 5B is a cross section taken along line VB—VB of FIG. 1;

FIGS. 5C and 5D are partial views showing alternate configurations of the slotted opening;

FIG. 8A is a cross section taken along line VIIIA—VIIIA of FIG. 6, and FIG. 8B is a cross section taken along line VIIIB–VIIIB of FIG. 6;

DETAILED DESCRIPTION OF THE PREFERRED EMBODIMENTS OF THE INVENTION

Specific embodiments of the invention will now be described with reference to the accompanying drawings. It is to be noted, however, that the following embodiments are simply illustrative and the invention is not limited to these embodiments.

Figure 1:
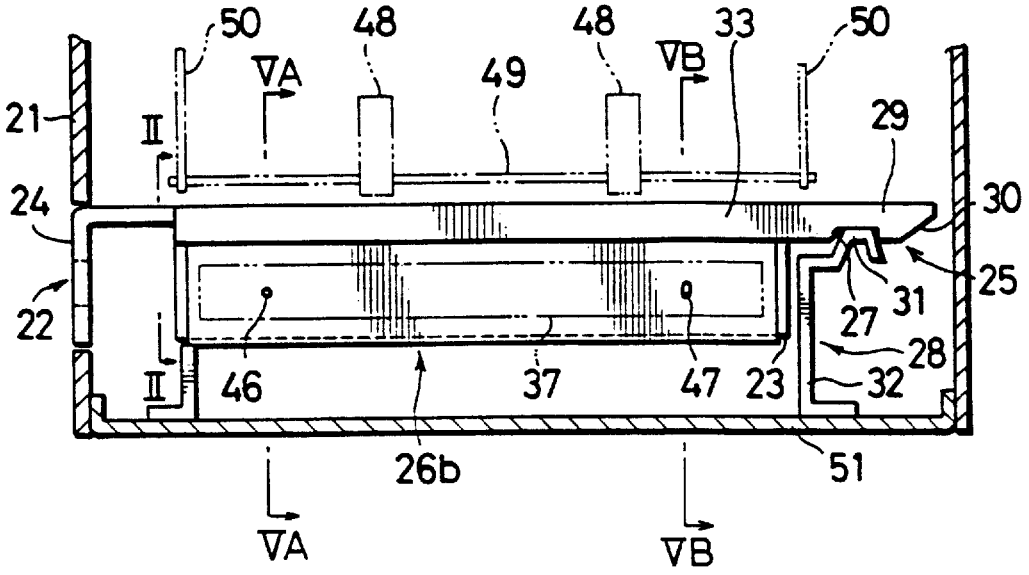
FIG. 1 is a cross section mainly showing a right-hand cassette mounting mechanism according to a first embodiment of the invention.
Figure 2:
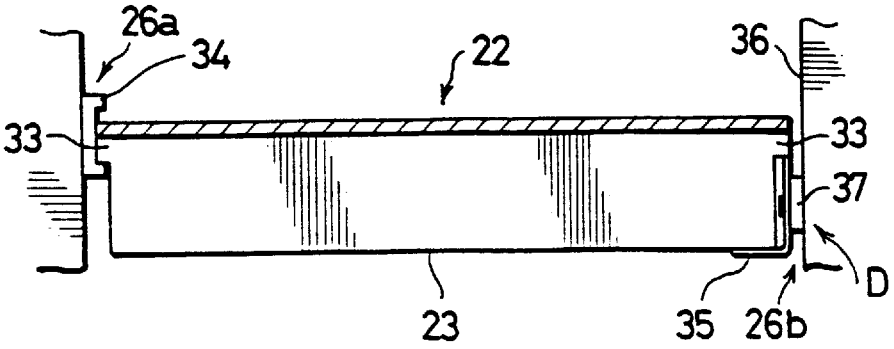
FIG. 2 is a cross section taken along line II—II of FIG. 1.
Figure 3:
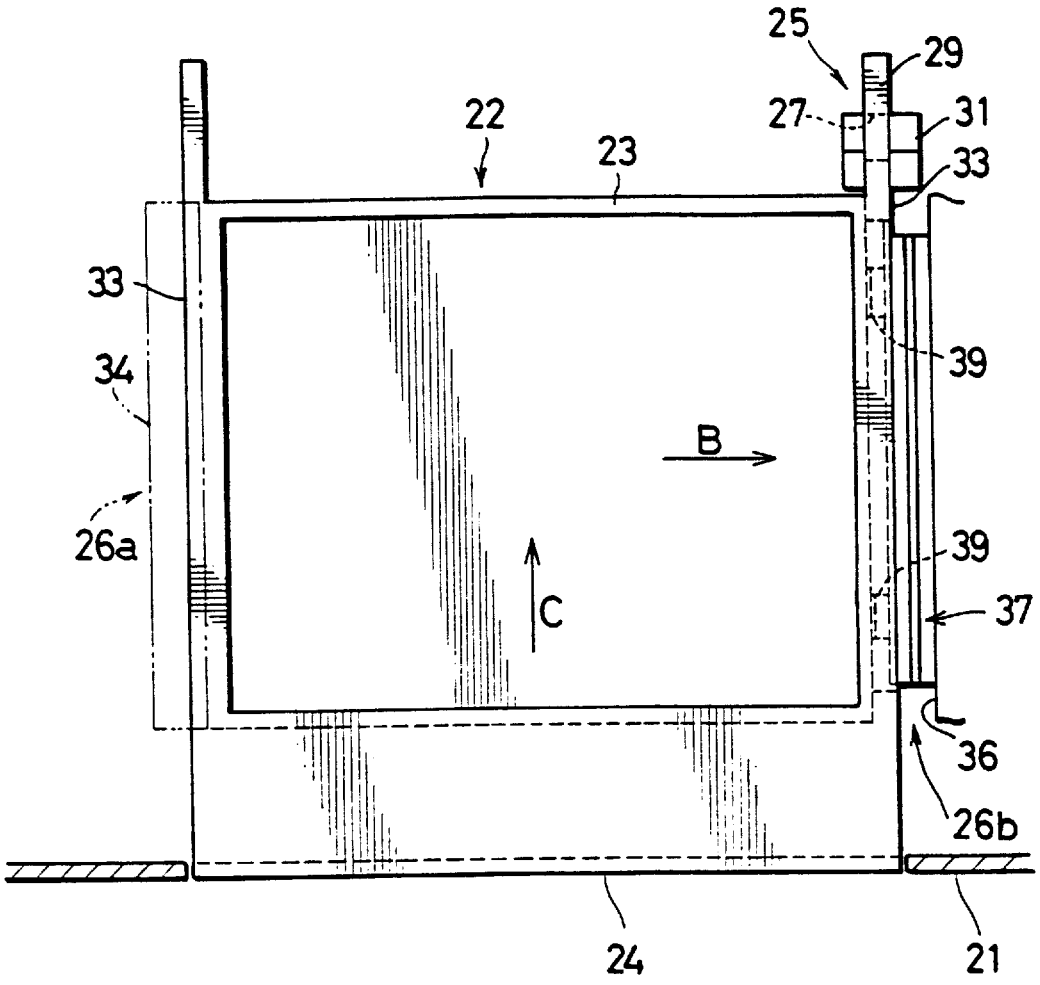
FIG. 3 is a plan view showing the cassette mounting mechanism of FIG. 1.

FIG. 1 is a cross section mainly showing a right-hand cassette mounting mechanism according to a first embodiment of the invention, FIG. 2 is a cross section taken along lines II—II of FIG. 1, and FIG. 3 is a plan view showing the cassette mounting mechanism of FIG. 1. Referring to FIG. 3, an arrow mark B shows a paper feeding direction while an arrow mark C shows a cassette inserting direction.

As shown in FIGS. 1 to 3, a paper cassette 22 holding sheets of paper is accommodated at a lower part of an apparatus 21, which may be a copying machine or a facsimile machine, for example, in such a way that the paper cassette 22 can be inserted and drawn out. The paper cassette 22 has a main boxlike structure 23, a handle 24 formed at the front of the boxlike structure 23, a cassette locking mechanism 25 provided at the rear of the boxlike structure 23, and cassette mounting mechanisms 26*a* and 26*b* provided between the boxlike structure 23 and the inside of the apparatus 21.

The boxlike structure 23 of the paper cassette 22 incorporates a paper stacking plate which is supported by a built-in compression spring from underneath with a stack of paper loaded on top of the paper stacking plate. Two corners of a topmost sheet of paper at both ends of its leading edge are initially held in position by separation pawls provided at upper positions corresponding to the two corners of the paper cassette 22.

The handle 24 extends in a lateral direction of the boxlike structure 23 of the paper cassette 22 at an upper front portion, and an extreme front part of the handle 24 hangs down to form a generally "L" shape in side view. This hanging front part of the handle 24 becomes flush with a front surface of the apparatus 21 when the paper cassette 22 is fully inserted into the apparatus 21. Formed at the front of the handle 24 is a horizontally elongate finger slot (not shown) having a specific width, which allows an operator to grip the handle 24 and draw out the paper cassette 22 from the apparatus 21 in a forward direction, or insert the paper cassette 22 to mount it in position in the apparatus 21.

The cassette locking mechanism 25 is constructed with a cutout 27 and a retaining member 28. A pair of laterally projecting flanges 33 are provided on left and right side walls of the boxlike structure 23 of the paper cassette 22, both the left-hand and right-hand flanges 33 having extending portions 29 which stretch out rearward farther beyond a rear surface of the boxlike structure 23. The cutout 27 is formed in a bottom edge of the extending portion 29 of the right-hand flange 33 and has a generally inverted "U" shape with its open side directed downward. The extending portion 29 of the right-hand flange 33 is obliquely cut from its rear edge toward the bottom edge, and this oblique portion, or a slope 30, connects to a short horizontal portion and then to the inverted U-shaped cutout 27. Mounted on a base plate 51 of the apparatus 21, the retaining member 28 has at its top a protruding part 31 which forms a generally inverted "U" shape as well as an upright supporting part 32 which extends downward from the protruding part 31. When the paper cassette 22 is inserted all the way into the apparatus 21, the protruding part 31 of the retaining member 28 interlocks with the cutout 27, and this interlocking action serves to secure the paper cassette 22 in position.

The left-hand cassette mounting mechanism 26*a* comprises the flange 33 which is provided at an upper position of the left-hand side wall of the boxlike structure 23 and extends in the cassette inserting direction C and a U-shaped guide rail 34 which fits over and supports the left-hand flange 33. On the other hand, the right-hand cassette mounting mechanism 26*b* comprises a bracket 35 fixed to the boxlike structure 23 of the paper cassette 22 below its right-hand flange 33 and a sliding guide assembly 37 mounted between an upright portion of the bracket 35 and a facing side wall member 36 which is provided inside the apparatus 21.

Figure 4:
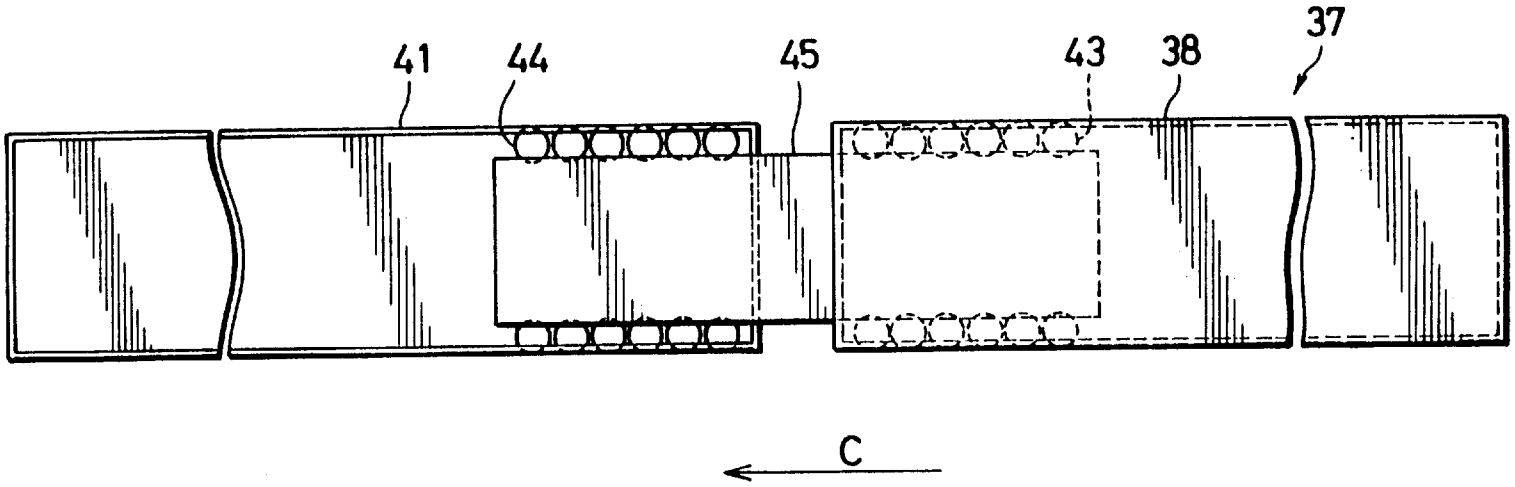
FIG. 4 is a front view depicting the detailed construction of a sliding guide assembly which is shown in FIG. 2.
Figure 6:
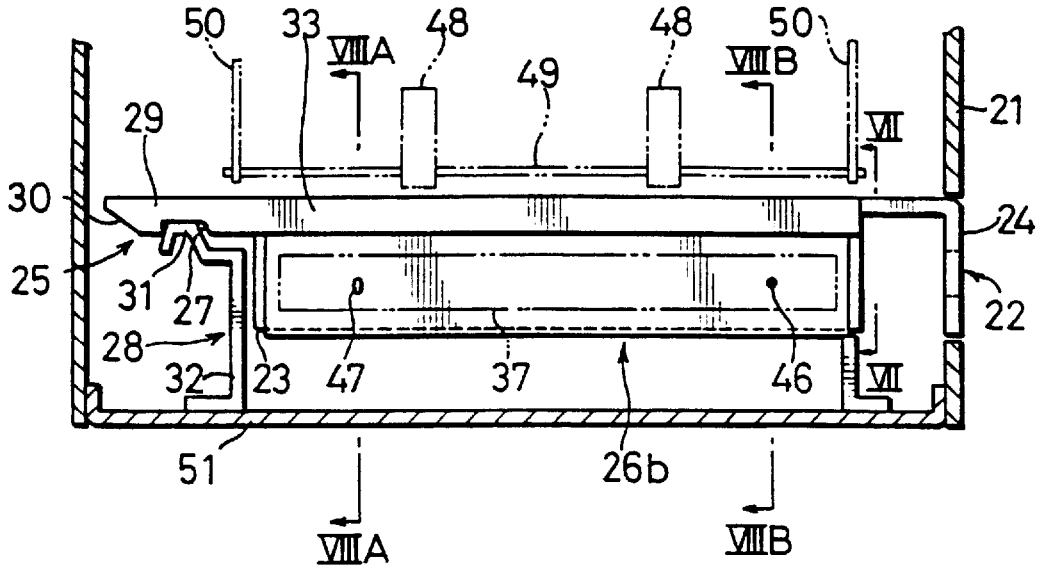
FIG. 6 is a cross section mainly showing a left-hand cassette mounting mechanism according to a second embodiment of the invention.
Figure 7:
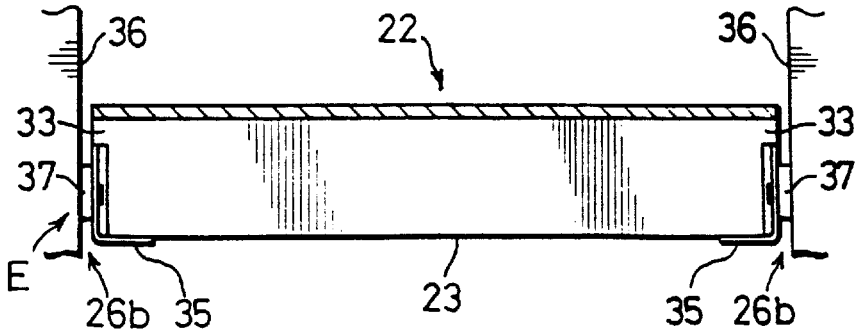
FIG. 7 is a cross section taken along line VII—VII of FIG. 6.
Figure 8A:
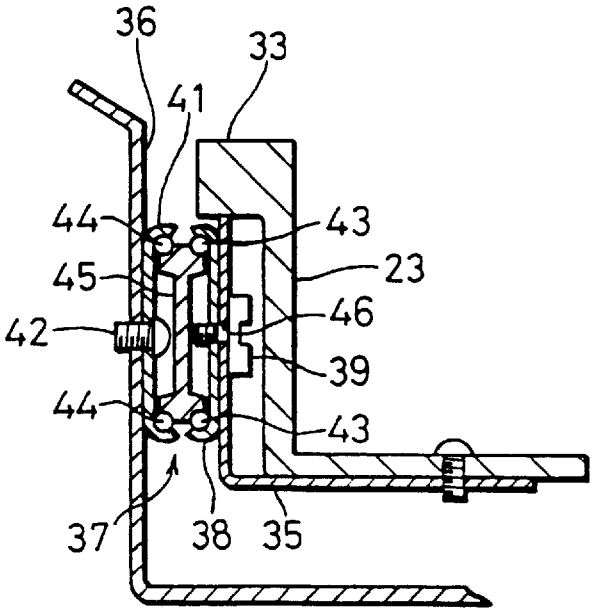
FIGS. 8A and 8B show the detailed construction of part E shown in FIG. 7, where
Figure 8B:
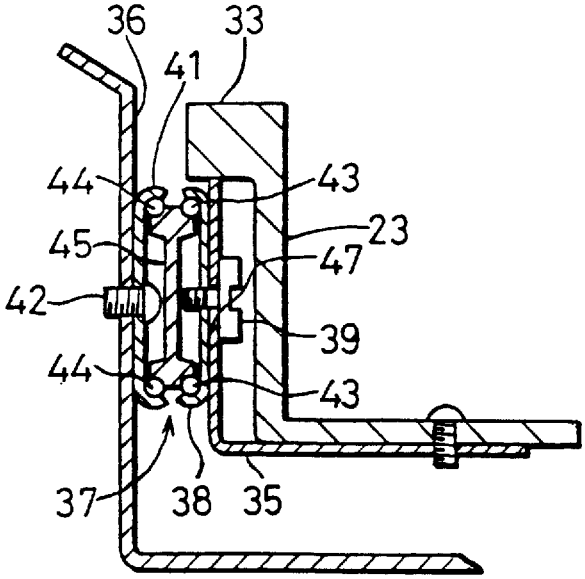
Figure 9:
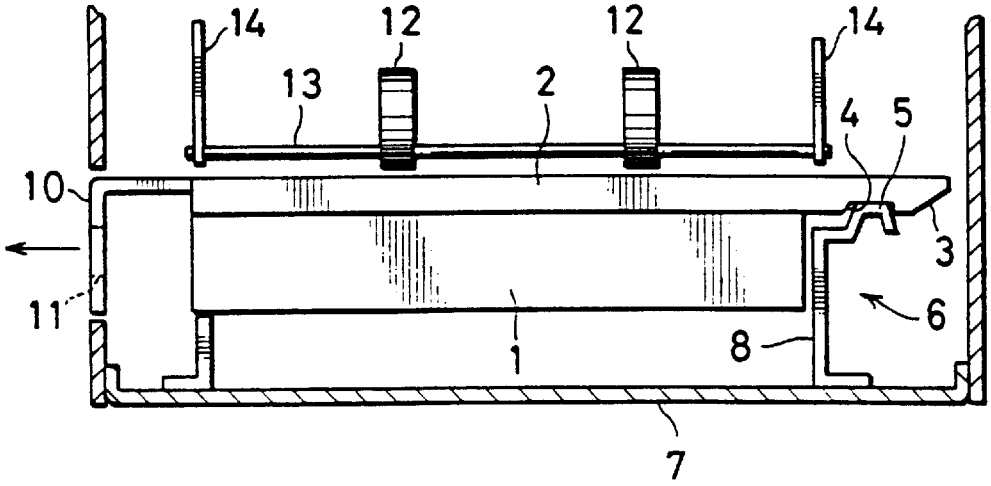
PRIOR ART FIG. 9
FIG. 9 is a cross-sectional side view showing the construction of a conventional cassette mounting mechanism.
Figure 10:
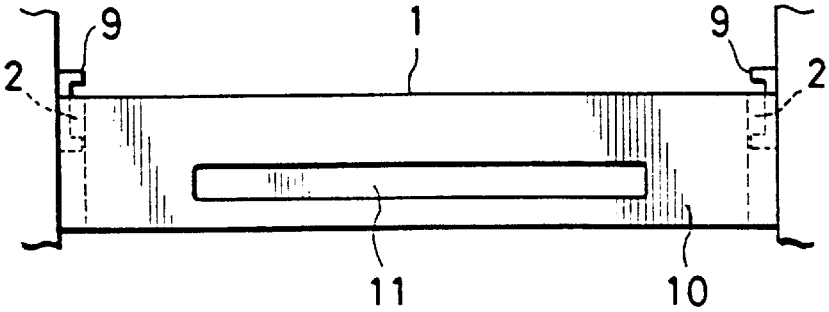
PRIOR ART FIG. 10
FIG. 10 is a front view showing the construction of the cassette mounting mechanism of FIG. 9.

As illustrated in FIG. 4, the sliding guide assembly 37 comprises inside and outside sliding plates 38, 41 and an intermediate plate 45 which is slidably placed between the two sliding plates 38, 41 with upper and lower rows of rolling balls 43 rotatably retained between the inside sliding plate 38 and the intermediate plate 45 and upper and lower rows of rolling balls 44 rotatably retained between the outside sliding plate 41 and the intermediate plate 45. With this configuration, the inside and outside sliding plates 38, 41 can smoothly slide relative to each other on both sides of the intermediate plate 45 without producing irregular shaky movements in their longitudinal directions, or parallel to the cassette inserting direction C. Depicted in FIG. 4 is a status in which the boxlike structure 23 of the paper cassette 22 attached to the inside sliding plate 38 has been fully pulled out. If the operator pushes the boxlike structure 23 in the cassette inserting direction C from this position, the inside sliding plate 38 moves together with the boxlike structure 23 and overlaps the outside sliding plate 41 with the intermediate plate 45 placed between the two sliding plates 38, 41, and the overall length of the sliding guide assembly 37 is reduced to a minimum when the paper cassette 22 is fully inserted.

FIG. 5A is a cross section taken along line VA—VA shown in FIG. 1, and FIG. 5B is a cross section taken along line VB—VB shown in FIG. 1. The bracket (fixing plate) 35 is attached to the inside sliding plate 38 of the sliding guide assembly 37 by screws 39 which are screwed into threaded holes in the inside sliding plate 38 at two points, one at the front as shown in FIG. 5A and the other at the rear as shown in FIG. 5B. On the other hand, the outside sliding plate 41 of the sliding guide assembly 37 is fixed to the side wall member 36 by screws 42 which are tightened into threaded holes formed in the side wall member 36. The bracket 35 is generally L-shaped in transverse cross section and is screwed to a bottom plate of the paper cassette 22 in such a way that a narrow space is allowed beneath the right-hand flange 33 to accommodate heads of the two screws 39 which serve as pin members. As shown in FIG. 1, a circular hole 46 and a slotted hole (or elongated hole) 47 are made in the bracket 35 for connecting it to the inside sliding plate 38. The slotted hole 47 is formed with its long axis generally aligned with a vertical direction so that a rear portion of the paper cassette 22 can swing up and down by a specified amount about the screw 39 fitted in the circular hole 46. Alternative configurations of the slotted hole may include an arc-shaped configuration 147*a* as shown in FIG. 5C or an oval configuration 147*b* as shown in FIG. 5D. The diameter of the circular hole 46 and the width (horizontal direction) of the slotted hole 47 are such that they will not allow the heads of the screws 39 to pass through, and the slotted hole 47 has at least such a length (vertical direction) that allows the rear portion of the paper cassette 22 to swing upward as much as required when the cutout 27 fits over the protruding part 31 of the retaining member 28. More specifically, the length of the slotted hole 47 is made approximately equal to or slightly greater than the depth of the cutout 27 in this embodiment. The depth of the cutout 27 itself is set to such a dimension that is sufficient to securely lock the paper cassette 22 in position, yet allowing the paper cassette 22 to be easily released when its handle 24 is pulled forward.

When the paper cassette 22 loaded with a stack of paper is fully inserted into the apparatus 21, a pair of paper feed rollers 48 having a generally semilunar shape, as viewed from the front, are located above the stack of paper with their side surfaces aligned parallel to the lateral direction of the paper cassette 22, as shown in FIG. 1. These two paper feed rollers 48 are mounted at front and rear positions of a rotating shaft 49. Both ends of the rotating shaft 49 are rotatably supported by front and rear fixing plates 50, and the rotating shaft 49 is connected to a rotating shaft of a drive motor (not shown). The height of the protruding part 31 of the retaining member 28 is such that the paper cassette 22 becomes parallel to the rotating shaft 49 when the protruding part 31 properly fits into the cutout 27.

When loading the paper cassette 22 with a new stack of paper or changing the paper size, the operator draws out the paper cassette 22 together with remaining paper, if any, from the apparatus 21 by pulling the handle 24 of the paper cassette 22. As the operator pulls handle 24, the cutout 27 in the right-hand flange 33 at the rear of the paper cassette 22 shifts obliquely forward along a rear sloping surface of the protruding part 31 and is released from the protruding part 31. Then, the paper cassette 22 smoothly slides horizontally forward without producing irregular movements as it is further pulled, guided by a left-hand linear guide composed essentially of the left-hand flange 33 and the U-shaped guide rail 34 and the right-hand sliding guide assembly 37.

After removing the paper cassette 22, the operator refills it with a new stack of paper or replaces it with another paper cassette 22 holding a stack of paper of a desired size, and then reinstalls the paper cassette 22 back to the apparatus 21 by holding and pushing the handle 24 of the paper cassette 22. As the operator inserts the paper cassette 22 into the apparatus 21, it is guided again by the left-hand linear guide composed essentially of the left-hand flange 33 and the U-shaped guide rail 34 and the right-hand sliding guide assembly 37 in a smooth manner without producing irregular movements. When the paper cassette 22 is fully inserted into the apparatus 21, the protruding part 31 of the retaining member 28 fits into the cutout 27 in the right-hand flange 33. More particularly, when the slope 30 at the rear end of the extending portion 29 of the right-hand flange 33 slides over the protruding part 31 of the retaining member 28, the rear portion of the paper cassette 22 swings upward and then downward about the screw 39 at the front that is passed through the circular hole 46. This up and down motion of the paper cassette 22 is allowed because the rear portion of the paper cassette 22 is supported by the screw 39 that is passed through the vertically elongate slotted hole 47. The cutout 27 and the protruding part 31 lock together from top and bottom directions in this manner, and this vertically-acting cassette locking mechanism 25 prevents the paper cassette 22 from coming off loose from the apparatus 21.

The two paper feed rollers 48 rotate together with their rotating shaft 49 when feeding each sheet of paper during a copying operation, for example. More particularly, as the paper feed rollers 48 having a generally semilunar cross section rotate, their concave and convex outer surfaces come in contact with the upper surface of a topmost sheet of paper and a resulting frictional force causes the topmost sheet of paper to be pushed in the paper feeding direction shown by the arrow mark B in FIG. 3. Individual sheets of paper successively peeled off from the underlying sheets by the separation pawls are fed into a paper path in this manner. The topmost sheet of paper fed from the paper cassette 22 is transported up to an image forming section of the apparatus 21 and an image is transferred on that sheet of paper.

As will be understood from the foregoing discussion, the paper cassette 22 is connected to the sliding guide assembly 37 by way of the bracket 35 which has the circular hole 46 at the front and the slotted hole 47 at the rear for passing the respective screws 39, and the rear portion of the paper cassette 22 swings upward and downward about the screw 39 at the front to allow the cutout 27 to properly fit over the protruding part 31 of the retaining member 28 which is fixed to the base plate 51 of the apparatus 21. The sliding guide assembly 37 of this embodiment enables smooth forward and rearward movements of the paper cassette 22 without making irregular shaky movements, and thereby ensures easy and comfortable handling of the paper cassette 22. Furthermore, the sliding guide assembly 37 makes it possible to employ the conventionally known vertically-acting, sure cassette locking mechanism, which is realized by a combination of the cutout 27 and the protruding part 31 in this embodiment, without requiring any additional components other than the sliding guide assembly 37.

With the provision of the cassette mounting mechanism **26*b* mainly composed of the bracket 35 attached to the right side of the paper cassette 22 and the sliding guide assembly 37, it is possible to prevent irregular lateral shaking of the paper cassette 22 and, therefore, the paper cassette 22 is positioned more accurately when inserted into the apparatus 21, realizing more stable paper feeding operation. In other words, it becomes easier to improve relative positioning accuracy of the paper cassette 22 and the paper feed rollers 48 and realize stable paper feeding operation since irregular movements of the paper cassette 22** are suppressed.

The earlier-mentioned conventional cassette mounting mechanism requires the flanges 2 formed on both the left and right sides of the paper cassette 1 as well as the U-shaped guide rails 9 which are long enough to accommodate the length of the individual flanges 2 for supporting paper cassette 1 in the apparatus. In the foregoing embodiment of the invention, the U-shaped guide rail 34 provided at the left can be made shorter than the length of the conventional the U-shaped guide rails 9 since the sliding guide assembly 37 is provided on the right side of the paper cassette 22. Furthermore, the right-hand sliding guide assembly 37 itself is made shorter than the conventional linear guides, and the flange 33 on the left side of the paper cassette 22 can also be made shorter than the flanges 2 of the conventional paper cassette 1.

While the paper cassette 22 is guided by the left-hand linear guide composed essentially of the left-hand flange 33 and the U-shaped guide rail 34 and the right-hand sliding guide assembly 37 with the cassette locking mechanism 25 provided at the rear of the right-hand sliding guide assembly 37 in the first embodiment described above, a second embodiment of the invention, which is illustrated in FIGS. 6, 7, 8A and 8B, is characterized by the provision of a pair of sliding guide assemblies 37 located on both the left and right sides of a paper cassette 22.

The first embodiment employing the sliding guide assembly 37 located only on the right side of the paper cassette 22 is advantageous in that the number of components can be reduced, and man-hours required for assembling as well as materials costs can be decreased compared to the second embodiment. In contrast, the second embodiment employing the sliding guide assemblies 37 located on both the left and right sides of the paper cassette 22 is advantageous in that the paper cassette 22 can be moved back and forth even more smoothly and, therefore, operation of the paper cassette 22 becomes easier and more comfortable than the first embodiment.

Only the right-hand sliding guide assembly 37 has the cassette locking mechanism 25 in the first embodiment while both the left and right sliding guide assemblies 37 have similar cassette locking mechanisms 25 in the second embodiment. The second embodiment may be modified in such a way that only the left or right cassette locking mechanism 25 has the cassette locking mechanism 25. This alternative form of the second embodiment helps reduce the number of components and thereby cut man-hour requirements for assembling as well as materials costs. It is to be recognized, however, the second embodiment having a pair of cassette locking mechanisms 25 provided on both the left and right sliding guide assemblies 37 exhibits a remarkably enhanced cassette locking effect.

In either the first or second embodiment, each bracket 35 having one each circular hole 46 and slotted hole 47 is made as a discrete component and attached to the paper cassette 22, which is of a conventional type, to allow the rear portion of the paper cassette 22 to swing up and down about the circular hole 46. In one variation of the invention, the bracket(s) 35 may be one-piece resin-molded with the paper cassette 22. Each bracket 35 is formed simultaneously with the paper cassette 22 in this approach and, therefore, it is not required to prepare a separate bracket 35 and attach it to the paper cassette 22.

The paper cassette 22 of either the first or second embodiment is connected to each sliding guide assembly 37 by two joints, one at the front composed essentially of the circular hole 46 and the screw 39 which has a round cross section and the other at the front composed essentially of the slotted hole 47 and the other screw 39. In this configuration, the rear portion of the paper cassette 22 can swing up and down about the screw 39 of the front joint as the screw 39 of the rear joint relatively slides along the slotted hole 47, and this swinging motion of the paper cassette 22 allows the cutout 27 to fit over the corresponding protruding part 31. The hole for fitting the screw 39 of the rear joint need not necessarily be a vertically elongate slotted opening, but may be a circular hole if it is large enough to allow the rear portion of the paper cassette 22 to swing up and down by such an amount that is sufficient to allow the cutout 27 and the protruding part 31 to interlock.

While the screws 39 serving as pin members have a circular cross section, these may be replaced by pin members having a noncircular cross section. What is essential for those pin members is that the rear portion of the paper cassette 22 should be made swingable about the front joint to allow the cutout 27 and the protruding part 31 to interlock.

Although each of the two joints is composed essentially of one each hole and pin member in the aforementioned embodiments, each joint may be formed by a combination of a projecting part and a recess. In another variation of the invention, there may be three or more joints, rather than two. In this variation, the front joint would serve as an axis of rotation while the middle and rear joints would function as sliding joints to allow the rear portion of the paper cassette 22 to make up and down swinging motions, for example. An increase in the number of joints will realize even more stable swinging operation of the paper cassette 22.

While the invention has thus far been described as being embodied in the cassette mounting mechanisms in the first and second embodiments, a paper holder mounting mechanism constructed in a similar way according to the invention may be employed in a two-sided printing (or copying) paper holding unit which receives and temporarily holds each sheet of paper carrying an image already formed on one side thereof and then feeds it to allow another image to be formed on the other side. This arrangement will also produce similar desirable effects of the invention.

What is claimed is:

1. A paper holder mounting mechanism comprising:

a paper holder having a rear portion;

a paper holder-receiving apparatus which receives said paper holder;

a vertically-acting paper holder locking mechanism at the rear portion of said paper holder and having an interlocking state with said paper holder-receiving apparatus when the paper holder is inserted into the paper holder-receiving apparatus;

a first sliding guide device having first and second slide parts slidable relative to one another;

a first connection connecting one of said slide parts to said paper holder-receiving apparatus; and first and second joints connecting the other slide part to said paper holder, said first and second joints being disposed such that the rear portion of the paper holder is swingable up and down about one of said first and second joints to effect said interlocking state of said paper holder locking mechanism.

2. A paper holder mounting mechanism as defined in claim 1, wherein said one slide part includes a first sliding plate and the other slide part includes a second sliding plate, said first and second sliding plates being opposingly arranged to each other, said first sliding guide device further including:

a first intermediate member placed between the first and second sliding plates;

a first group of upper and lower rolling members rotatably retained between the intermediate member and the first sliding plate; and a second group of upper and lower rolling members rotatably retained between the intermediate member and the second sliding plate, whereby the first and second sliding plates are slidable relative to each other.

3. A paper holder mounting mechanism as defined in claim 2, wherein said second sliding plate has a front portion and a rear portion, said first joint including a first connecting member for connecting said front portion of the second sliding plate to the paper holder, said second joint including a second connecting member for connecting said rear portion of the second sliding plate to the paper holder land the, said paper holder being vertically displaceable with respect to the second connecting member.

4. A paper holder mounting mechanism as defined in claim 3 wherein the paper holder has a side portion, further comprising a fixing plate fixedly attached to the side portion of the paper holder, said fixing plate having an elongated hole, said second connecting member being vertically displaceable in said elongated hole.

5. A paper holder mounting mechanism as defined in claim 4, wherein said second sliding plate is slidable with respect to said fixing plate.

6. A paper holder mounting mechanism as defined in claim 5, wherein the elongated hole is in the shape of an arc.

7. A paper holder mounting mechanism as defined in claim 6, wherein the second connecting member includes a screw bolt having a screw portion and a head portion, said screw bolt being fixedly connected to the second sliding plate through the elongated hole of the fixing plate, and a horizontal width of the elongated hole is greater than the diameter of the screw portion of the screw bolt and less than the diameter of the head portion of the screw bolt.

8. A paper holder mounting mechanism as defined in claim 5, wherein the elongated hole has an oval shape.

9. A paper holder mounting mechanism as defined in claim 2 further comprising:

a second sliding guide device having third and fourth slide parts slidable relative to one another;

a second connection connecting one of said third and fourth slide parts to said paper holder-receiving apparatus;

third and fourth joints connecting the other of said third and fourth slide parts to said paper holder, said third and fourth joints being disposed such that the rear portion of the paper holder is swingable up and down about one of said third and fourth joints to effect said interlocking state of said paper holder locking mechanism.

10. A paper holder mounting mechanism as defined in claim 9, wherein said one slide part of said third and fourth slide parts includes a third sliding plate and the other slide part of said third and fourth slide parts includes a fourth sliding plate, said third and fourth sliding plates being opposingly arranged to each other, said second sliding guide device further including:

a second intermediate member placed between the third and fourth sliding plates;

a third group of upper and lower rolling members rotatably retained between the second intermediate member and the third sliding plate; and a fourth group of upper and lower rolling members rotatably retained between the second intermediate member and the fourth sliding plate, whereby the third and fourth sliding plates are slidable relative to each other.

11. A paper holder mounting device comprising:

a paper holder;

a paper holder-receiving apparatus which receives said paper holder, said paper holder having an inserted position in said paper holder-receiving apparatus;

a vertically acting paper holder locking mechanism having one part on said paper holder and another part on said paper holder-receiving apparatus, said two parts being in a locking state when said paper holder is in said inserted position in said paper holder-receiving apparatus;

a sliding guide device having two slide parts slidable relative to one another;

a first connection connecting one of said slide parts to said paper holder-receiving apparatus; and a second connection connecting the other slide part to said paper holder, said second connection including a pivotal mounting between said paper holder and said other slide part to provide for pivoting of said paper holder relative to said other slide part about said pivotal mounting as said paper holder moves into and out of said locking state.

12. A paper holder mounting device according to claim 11 wherein said paper holder includes a fixing plate, said fixing plate having an opening, said second connection further comprising a connecting member passing through said opening and being connected to said other slide part, said fixing plate being displaceable relative to said connecting member as said paper holder pivots about said pivotal mounting.

13. A paper holding mounting device according to claim 11 wherein said sliding guide includes an intermediate member and rolling members between said intermediate member and each of said two slide parts.

14. A paper holder mounting device according to claim 13 wherein said paper holder is in a fully inserted position when said paper locking mechanism is in said locking state, said paper holder having a non-fully inserted elevated position, said paper holder being at one pivotal position when said locking mechanism is in said fully inserted position, said paper holder being at another pivotal position when said paper holder is in said elevated position.

15. A paper holder mounting device according to claim 11 wherein said first connection precludes relative movement between said one slide part and said paper holder-receiving apparatus.

16. A paper holder mounting device comprising:

a paper holder;

a paper holder-receiving apparatus which receives said paper holder, said paper holder having an inserted position in said paper holder-receiving apparatus;

a paper locking mechanism having one part on said paper holder and another part on said paper holder-receiving apparatus, said two parts being in a locking state when said paper holder is in said inserted position in said paper holder-receiving apparatus;

a sliding guide device including two slide parts and rollable members in which said two slide parts are slidable relative to one another on said rollable members;

a first connection connecting one of said slide parts to said paper holder-receiving apparatus; and a second connection connecting the other slide part to said paper holder, said second connection including a pivotal mounting between said paper holder and said other slide part to provide for pivoting of said paper holder relative to said other slide part about said pivotal mounting as said paper holder moves into and out of said locking state.

* * * * *